United States Patent [19]

Braun et al.

[11] Patent Number: 4,570,704

[45] Date of Patent: Feb. 18, 1986

[54] SUPPORT FOR HEAT EXCHANGER TUBES

[75] Inventors: Richard R. Braun, El Paso, Tex.; Charles E. Cedar, Hibbing, Minn.

[73] Assignee: L & M Radiator, Inc., Hibbing, Minn.

[21] Appl. No.: 593,482

[22] Filed: Mar. 26, 1984

[51] Int. Cl.[4] ..... F28F 9/00

[52] U.S. Cl. ..... 165/162; 165/172

[58] Field of Search ..... 165/162, 172

[56] References Cited

U.S. PATENT DOCUMENTS

| | | | |
|---|---|---|---|
| 1,831,533 | 11/1931 | Hubbard | 165/172 |
| 2,927,781 | 3/1960 | Fohrhaltz et al. | 165/162 |
| 3,677,339 | 7/1972 | Perrin et al. | 165/162 |
| 3,924,676 | 12/1975 | Bennett | 165/172 |
| 3,934,645 | 1/1976 | Butts | 165/172 X |
| 4,007,773 | 2/1977 | McCormick | 165/69 |
| 4,030,540 | 6/1977 | Roma | 165/172 |
| 4,036,289 | 7/1977 | Cheng et al. | 165/172 X |
| 4,167,211 | 9/1979 | Haller | 165/162 X |
| 4,216,824 | 8/1980 | Braun et al. | 165/69 |
| 4,245,694 | 1/1981 | Smith | 165/172 X |
| 4,344,478 | 8/1982 | Petaja et al. | 165/69 |

FOREIGN PATENT DOCUMENTS

| | | | |
|---|---|---|---|
| 306869 | 2/1929 | United Kingdom | 165/172 |
| 671711 | 4/1952 | United Kingdom | 165/162 |
| 1461461 | 1/1977 | United Kingdom | 165/172 |
| 1519757 | 8/1978 | United Kingdom | 165/172 |
| 1590918 | 6/1981 | United Kingdom | 165/162 |

*Primary Examiner*—Albert W. Davis, Jr.
*Assistant Examiner*—Peggy Neils
*Attorney, Agent, or Firm*—Allegretti, Newitt, Witcoff & McAndrews, Ltd.

[57] ABSTRACT

An improved support for a heat exchanger is disclosed and includes a support member providing four engagement surfaces. The surfaces of adjacent supports, within the heat exchanger, engage so as to provide a force distribution system therein, such that the strength and rigidity of the heat exchanger are enhanced.

8 Claims, 11 Drawing Figures

SUPPORT FOR HEAT EXCHANGER TUBES

BACKGROUND OF THE INVENTION

The present invention relates generally to a heat exchanger having removable tube-and-fin assemblies, such as found in a diesel engine cooling system, and more particularly to a support for the tube-and-fin assemblies such that the overall strength and rigidity of the heat exchanger is enhanced.

A heat exchanger includes a multiplicity of tube-and-fin assemblies. The tube-and-fin assemblies are mounted in headers, arranged in columns and rows, and interconnected to receive and pass a heating/cooling fluid (dependent upon application).

In certain environments, the tube-and-fin assemblies must have considerable length in order to provide sufficient heat transfer. The rigidity of the assembly decreases with increased length, and thus it is often necessary in such applications to include a central header, in essence splitting the tube-and-fin assemblies. Utilization of a central header does, however, substantially reduce fin surface area, thereby reducing heat transfer capacity.

Each tube-and-fin assembly is removable from the headers for repair and/or replacement. One such assembly includes a generally elliptical tube having flat or flattened sides and a pair of heat-dispensing fins secured along the flat sides of the tube. In another type of assembly, the tube configuration is substantially circular in cross section. As is well known in the art, the fluid passes through the tube and heat therefrom is dispensed by the fins into the environment.

To ensure proper operation and sufficient heat transfer (e.g., cooling of the fluid in a radiator application and heating of the environment in a heat recovery application), it is desirable to maintain the spacing between tube-and-fin assemblies and to substantially control movement and/or vibration, without substantial forfeiture of fin surface area. On the one hand, movement and vibration of the tube-and-fin assemblies, as a result of operation or impact, can produce serious damage due to (i) excessive movement or deflection of individual assemblies, or (ii) contact between adjacent assemblies. Any loss of fin surface area, on the other hand, renders the heat exchanger less effective for a particular application.

It is possible to essentially band together the rows and/or columns of tube-and-fin assemblies and thereby increase the strength and rigidity of the heat exchanger. This, unfortunately, substantially inhibits the ready removal and repair or replacement of any single damaged assembly.

To avoid the repair problem, various "spacers" are now available. One such spacer is shown in U.S. Pat. No. 4,216,824, and the teachings thereof are incorporated herein by reference. One difficulty with this spacer and others presently available is that, with vibration, the spacer can dislodge or separate from the tube-and-fin assembly, thereby becoming ineffective. Further, the presently available spacers do not provide sufficient support in applications involving long tube-and-fin assemblies (e.g., in excess of forty inches in a typical vertical radiator application) or severe duty (e.g., an earth-moving vehicle) to eliminate the need for center headers.

More significantly, however, the presently available spacers and spacing mechanisms fail to accomplish the dual purpose of protecting the tube-and-fin assemblies from damage while maintaining the individuality of the assemblies. As such, the "trade-off" for protection is substantially increased difficulty in inspection, removal, and repair.

SUMMARY OF THE INVENTION

The present invention is an improved support for use in connection with the tube-and-fin assemblies of a heat exchanger. Significantly, the support is designed to be securely fastened to each individual assembly, to engage adjacent supports so as to enhance the strength and rigidity of the overall heat exchanger assembly, and to provide for easy removal of assemblies during repair.

In its simplest aspect, the present invention is an integral, wrap-around support designed to provide four engagement surfaces, i.e., two substantially parallel lateral engagement surfaces and two substantially parallel longitudinal engagement surfaces. In the assembled state, all four surfaces contact the opposing surfaces of adjacent supports so as to structurally interconnect the tube-and-fin assemblies of the heat exchanger. This structural engagement or interconnection maintains the proper spacing between tube-and-fin assemblies and provides a force distribution system. Any force executed upon the heat exchanger is thus spread and dissipated, substantially improving the strength of the heat exchanger.

In a more detailed aspect, the support includes first and second interconnecting support members. The support members provide the four engagement surfaces and further include a longitudinal interlock projection and the longitudinal interlock channel, respectively. The longitudinal interlock projection and channel are matched, i.e., have substantially the same configuration and dimensions. As such, the longitudinal interlock projection of one support will, in the assembled state, engage and interlock with the longitudinal interlock channel of an adjacent spacer, thereby securing the supports in a fixed relationship in the lateral direction. The interlocking feature, in combination with the engagement of opposed support surfaces, enhances strength, rigidity, and the distribution of forces tending to distort the configuration of the tube-and-fin assemblies.

It is thus an object of the present invention to provide an improved support for use with the tube-and-fin assemblies of a heat exchanger. Another object is an improved support having an interconnecting capacity to increase the strength and rigidity of the heat exchanger. A further object is an improved, interconnecting support structurally suitable for both staggered and in-line heat exchanger configurations.

Another object of the present invention is a support for a heat exchanger which is securable to the tube-and-fin assemblies and which is interlockable with respect to adjacent supports. It is also an object to provide an interlocking supoprt for use in conjunction with tube-and-fin assemblies so as to substantially control and minimize movement and vibration thereof during operation.

It is also an object of the present invention to provide an improved assembly support readily adaptable to the various tube configurations. It is a further object to provide an improved support for use with long tube-and-fin assemblies, so as to eliminate, in many applications, the need for a center header. Still another object is an improved assembly support whereby the individuality of the assemblies is maintained, thereby facilitating inspection, removal, repair, and replacement.

Yet another object is an improved assembly support providing a substantial reduction in the costs of the heat exchanger. Finally, it is also an object of the present invention to provide an improved tube-and-fin assembly support which is inexpensively manufactured and readily applied.

These and other objects, features and advantages of the present invention are set forth or implicit in the following detailed description.

BRIEF DESCRIPTION OF THE DRAWING

Various preferred embodiments of the present invention are described herein, in detail, with reference to the drawing wherein.

DETAILED DESCRIPTION OF A PREFERRED EMBODIMENT

Referring to FIGS. 1–11, four preferred embodiments of the present invention are shown as an improved support 10 for use in conjunction with a tube-and-fin assembly 12. As is well known, the tube-and-fin assembly 12 forms a part of a heat exchanger (not shown). More particularly, the heat exchanger includes a multiplicity of assemblies 12 arranged in rows and columns and interconnected between upper and lower headers (not shown). The rows extend longitudinally across the heat exchanger, substantially perpendicular to the direction of air flow, and the columns are substantially perpendicular to the rows. The columns may be "in-line" or "staggered" as shown below (top view of tube-and-fin assemblies):

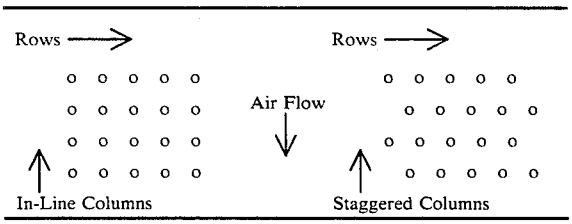

Figure 1:
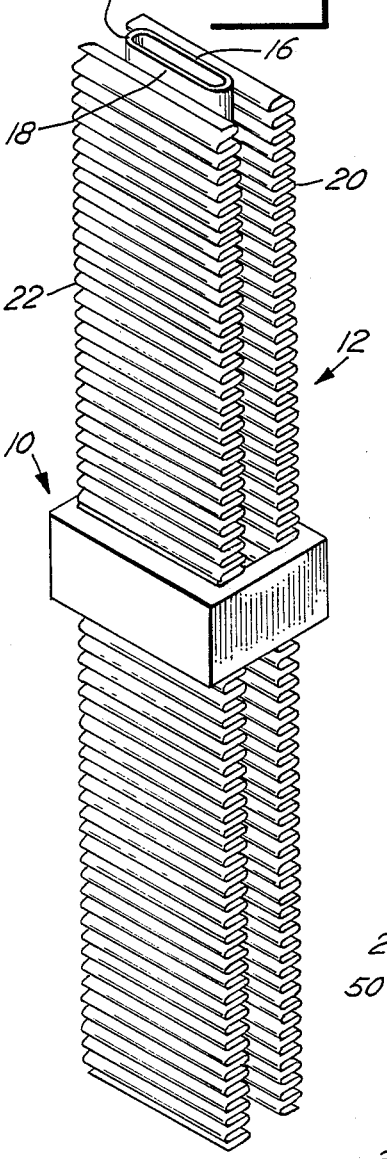
FIG. 1 is an isometric view of a tube-and-fin assembly including a first preferred embodiment of the present invention.

As best shown in FIG. 1, the assembly 12 includes a generally elliptical tube 14, having flat sides 16, 18, and a pair of heat-dispensing fins 20, 22, secured along the flat sides 16, 18. It is to be understood, however, that the tube 14 and fins 20, 22 may have virtually any configuration and that only minor modifications of the supports 10, shown herein, are necessary to accommodate such other configurations.

The support 10 may be integral, may include parts to be glued or welded together, or may include interconnecting, snap-together parts. In either case, the support 10 is manufactured from a temperature and fluid resistant material, such as a metal or thermoplastic appropriate to the application. Thus, the support 10 may be machined or injection molded. Further, the support 10 may be secured to the tube-and-fin assembly 12 with or without removal of fin material.

Figure 2:
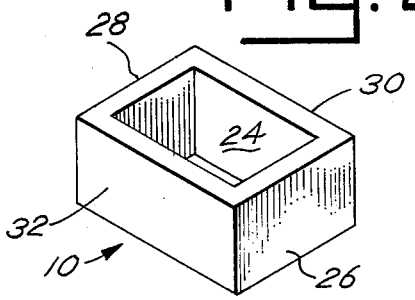
FIG. 2 is another isometric view of the preferred embodiment shown in FIG. 1.

Referring to FIGS. 1 and 2, the simplest support 10 is shown. This support 10 is preferably an integral, elastomeric (e.g., polyurethane) member, designed to be "stretched" during application to the tube-and-fin assembly 12. At the proper position, the support 10 is released from the "stretched" state and secured to the tube-and-fin assembly 12 by compression and distortion of the fins 20, 22 within the support 10.

As best shown in FIG. 2, the integral support member 10 is substantially rectangular and defines a central channel 24 adapted to receive the tube-and-fin assembly 12. The support 10 provides four engagement surfaces, i.e., two longitudinal engagement surfaces 26, 28, respectively, and two lateral engagement surfaces 30, 32, respectively. (As used herein, the terms "longitudinal" and "lateral" are related to heat exchanger and the direction of air flow therein. The term "longitudinal" means substantially parallel to the longitudinal axis of a typical heat exchanger and thus substantially perpendicular to the air flow; "lateral" means substantially parallel to the direction of air flow.)

The four engagement surfaces 26, 28, 30, 32 provide an engaging interconnection between tube-and-fin assemblies 12 in the assembled state. In either the in-line or staggered configuration, the surfaces 26, 28, 30, 32, or a portion thereof, engage the opposing surfaces of adjacent supports 10, such that any movement of one tube-and-fin assembly 12 exerts a force, through the engagement, upon a multiplicity of adjacent assemblies 12. This distribution dissipates the force, substantially improving the strength of the overall heat exchanger structure. That is, the force distortion or damage level of the heat exchanger is enhanced.

Although an integral support 10 is shown in FIGS. 1 and 2, the support 10 may comprise matching parts or halves, bonded or snapped together during application to the tube-and-fin assembly 12. Further, the support 10 could be modified such that the central channel 24 conforms and corresponds to the configuration of the tube 14 itself. In this case, a portion of the fins 20, 22 is removed prior to application of the support 10. Affixation to the tube-and-fin assembly 12 in the manner herein described avoids support dislodging and separation due to normal or impact vibrations.

Figure 3:
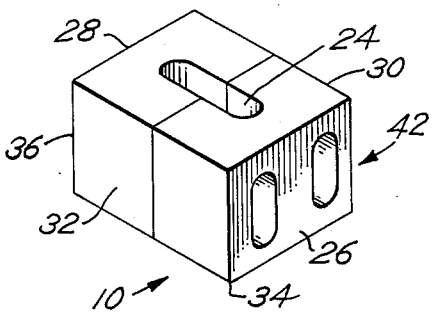
FIG. 3 is an isometric view of a second preferred embodiment of the present invention.
Figure 4:
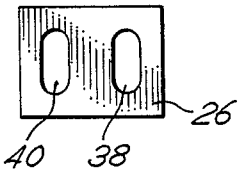
FIG. 4 is a front end view of the preferred embodiment shown in FIG. 3.

A second preferred embodiment of the present invention is shown in FIGS. 3 and 4. (Common numerals are utilized to designate features common to all embodiments.) This support 10 preferably includes first and second support members 34, 36, which are substantially identical in configuration. With this preferred embodiment, a portion of the fins 20, 22 is preferably removed prior to application.

The first and second support members 34, 36 again provide four longitudinal and lateral engagement surfaces 26, 28, 30, 32 and cooperate to define the central channel 24. As shown, the central channel 24 closely corresponds to the tube 14 to provide a close, engaging fit between the support 10 and the tube-and-fin assembly 12. The first and second support members 34, 36 may also be secured together at the joints in any conventional manner, e.g., by an adhesive or interconnecting arrangement.

In this preferred embodiment, the first and second support members 34, 36 also cooperate to define at least one and preferably first and second lateral passageways 38, 40 through the support 40. As shown, the lateral passageways 38, 40 extend on opposite sides of the tube 14.

The lateral passageways 38, 40 provide lateral access means, generally designated 42, for interconnecting tube-and-fin assemblies 12 by column, i.e., in the lateral direction, in both the in-line and staggered configurations. A bolt (not shown) is inserted through the aligned lateral passageways 38, 40 within a column and secured by a nut (not shown). Each column is thus interconnected and joined so as to resist substantially longitudinal forces exerted thereon, and the heat exchanger is structurally strengthened.

Figure 5:
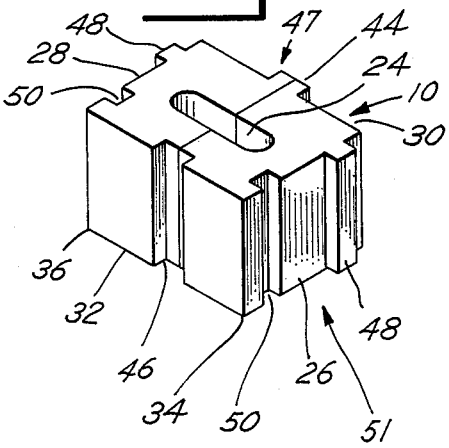
FIG. 5 is an isometric view of a third preferred embodiment.
Figure 6:
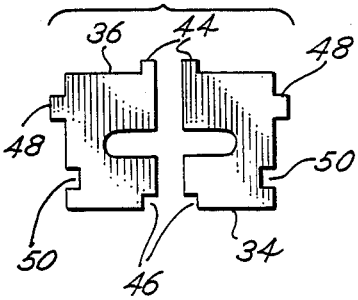
FIG. 6 is a top view of the preferred embodiment shown in FIG. 5.

A third support 10 is shown in FIGS. 5 and 6. The support 10 includes two support members 34, 36, two longitudinal engagement surfaces 26, 28, two lateral engagement surfaces 30, 32, and a central channel 24 in secured engagement with the tube 14.

In this preferred embodiment, the first and second support members 34, 36 cooperate to define a longitudinal interlock projection 44 and a longitudinal interlock channel 46. The longitudinal interlock projection and channel 44, 46 are matched, i.e., the location, configuration and dimensions thereof are such that the channel 46 of a first support 10 will receive the projection 44 of a second, adjacent support 10 within the assembled heat exchanger. This engagement, in the longitudinal direction, interlocks adjacent tube-and-fin assemblies 12 against force components in the lateral direction, again enhancing the structural resistance of the heat exchanger.

As such, the first and second support members 34, 36 define, in cooperation, longitudinal interlock means, generally designated 47, for interlocking longitudinally adjacently assemblies 12 against substantially lateral forces exerted upon the heat exchanger. As shown, the projection 44 extends from the lateral engagement surface 30, and the groove 46 is positioned along the lateral engagement surface 32.

Each support member 34, 36 also includes a lateral interlock projection 48 and a lateral interlock channel 50. The first and second support members 34, 36 thus cooperate to define lateral interlock means, generally designated 51. The lateral interlock means 51, in a manner similar to the longitudinal interlock means 47, interlocks laterally adjacent supports 10 against substantially longitudinal forces.

This configuration of the support 10 provides for interlocking of adjacent tube-and-fin assemblies 12 in both the longitudinal and lateral directions, irrespective of the configuration of the tube-and-fin assemblies 12 within the heat exchanger (in-line or staggered). This interlocking against all force vectors provides substantial resistance to distortion and/or damage.

More particularly, the lateral interlock projections 48 of the support 10 are opposed and substantially align in the lateral direction (not displaced longitudinally). Likewise, the lateral interlock channels 50 are opposed and substantially laterally aligned, being displaced longitudinally with respect to the projections 48. The projections 48 and channels 50 are again matched, as previously defined. In the in-line configuration, the orientation of the support 10 upon the assembly 12 is reversed by row such that projections 48 in one row correspond with the channels 50 in adjacent rows.

A fourth and final support 10 is shown in FIGS. 7–11. As shown, the support 10 includes the first support member or section 34, the second support member or section 36, and hinge means, generally designated 52. The first and second support members 34, 36 define, cooperatively, the central channel 24 and the engagement surfaces 26, 28, 30, 32. The hinge means 52 hingedly secures the first support member 34 to the second support member 36 such that the support 10 is operable in a closed state (illustrated in FIG. 7) and an open state (illustrated in FIG. 9). The support 10 is preferably integral, and the hinge means 52 therein comprises a thin interconnecting wall. The first and second support members 34, 36 may, however, be separate parts to be glued, welded, or snapped together.

The first support member 34 includes the longitudinal interlock projection 44 extending from the lateral engagement surface 30. The longitudinal interlock projection 44 is preferably centrally located and preferably substantially trapezoidal, tapering towards the engagement surface 30. Opposite the hinge means 52, the first support member 34 further includes an outwardly-turned flange 54, which defines a substantially vertical, outwardly opening groove 56.

Figure 8:
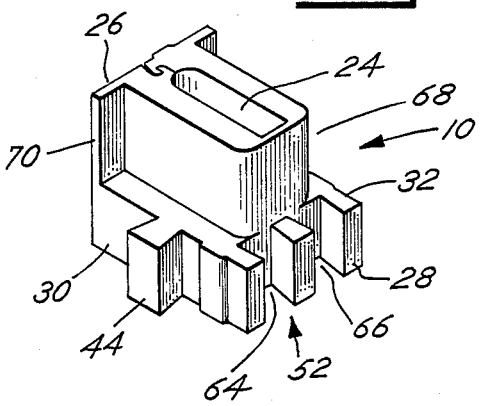
FIG. 8 is another isometric view of the preferred embodiment shown in FIG. 7.
Figure 9:
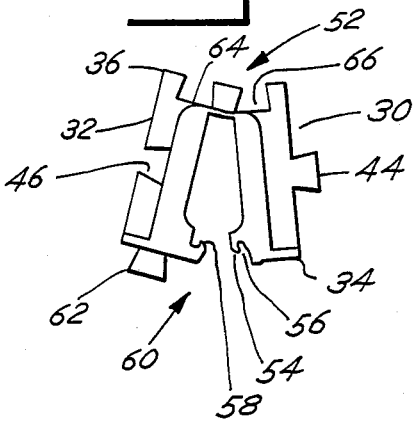
FIG. 9 is a top view of the preferred embodiment shown in FIG. 7 illustrated in an open state.

The second support member 36 defines the longitudinal interlock channel 46. The channel 46 is centrally located with respect to the engagement surface 32 such that the longitudinal interlock projection and channel 44, 46, respectively, substantially align in the closed state. As best shown in FIG. 8, the axes of projection 44 and channel 46 are substantially colinear in closed state.

The projection and channel 44, 46 are matched as well as mated. The mating relationship interlocks the projection and channel 44, 46 irrespective of the direction of force. Any mating configuration (e.g., trapezoidal or keyhole) may be utilized.

The second support member 36 also includes a lip or hook 58 adapted to interact with the groove 56 of the first support member 34. As the support 10 is closed, i.e., guided into the closed state shown in FIG. 7, the ends of the first and second support members 34, 36, opposite the hinge means 52, engage and, with force, the lip 58 engages and "snaps" into the groove 56. This engagement secures the first support member 34 with respect to the second support member 36 in the closed state. As such, the first and second support members 34, 36 cooperate to define secure means, generally designated 60, for securing the support members 34, 36, together and in a fixed relationship.

Figure 7:
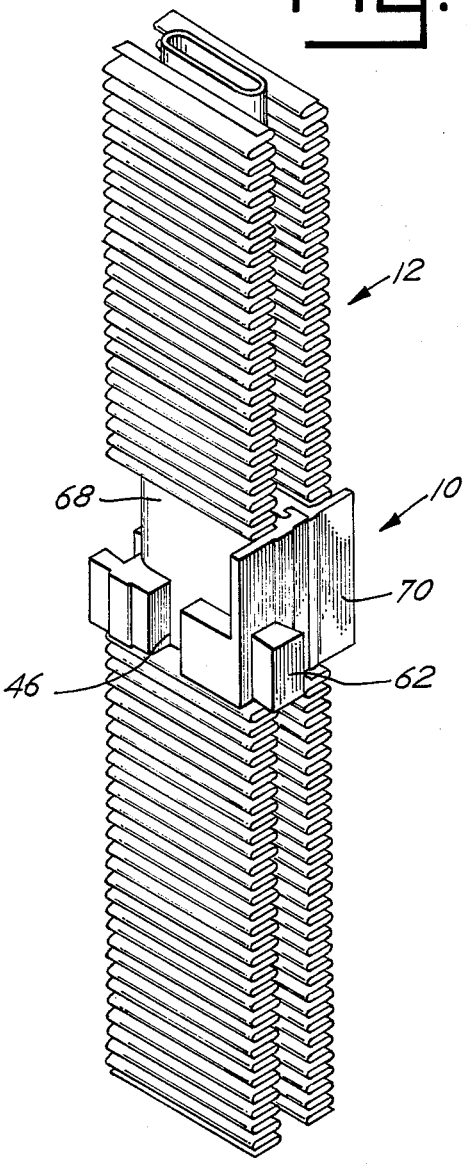
FIG. 7 is an isometric view of a tube-and-fin assembly having a fourth preferred embodiment of the present invention.

As best shown in FIG. 7, the support 10 tightly engages or "pinches" the tube 14 so as to securely affix the support 10 thereto. The fins of the assembly 12 are, with this preferred embodiment, removed prior to application of the support 10.

The first and second support members 34, 36 further define, in cooperation, a lateral interlock projection 62 and a pair of lateral interlock channels 64, 66, respectively. As shown, the lateral interlock projection and channel 62, 64 are a part of the second support member 36 and substantially align in the lateral direction. Further, the projection 62 matches and mates with both interlock channels 64, 66, in configuration and dimensions. As with the longitudinal interlock projection 44, the lateral interlock projection 62 is preferably trapezoidal and tapered.

The interlocking of adjacent supports 10 (via the longitudinal interlock projections and channels 44, 46 and via the lateral interlock projections and channels 62, 64, 66) provides a structural grid pattern effective in dissipating destructive forces exerted upon the heat exchanger. (The projection 62 interlocks with the channel 64 in the in-line configuration and with the channel 66 in the staggered configuration.) The interlock pattern substantially increases the rigidly and strength of the overall structure and substantially reduces the possibility of damage to the individual tube-and-fin assemblies 12 when subjected to vibration and/or impact forces.

In this preferred embodiment, the first and second support members or sections 34, 36 further cooperate to define an extension wall 68, substantially coextensive with the central channel 24. This extension wall 68 provides an elongation of the central channel 24 to further enhance attachment of the support 10 to the tube-and-fin assembly 12. The extension wall 68 also provides clearance for the interlocking projections 44, 62 during assembly and disassembly.

Figure 10:
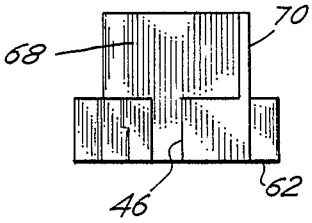
FIGS. 10 and 11, respectively, are left and right side views of the preferred embodiment shown in FIG. 7.
Figure 11:
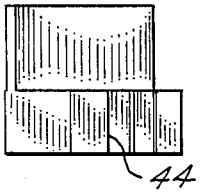

In addition, the support members 34, 36 define an air baffle 70, substantially coplanar with and thereby extending the longitudinal engagement surface 26. As best shown in FIG. 10, the air baffle 70 extends the height of the extension wall 68. The air baffle 70 substantially avoids the passage of air along and adjacent the extension wall 68, diverting the air flow in this area into contact with the heat-dispensing fins 20, 22 above and below the support 10.

The supports 10 shown herein enhance the strength and overall performance of the heat exchanger and maintain the individuality of the tube-and-fin assemblies 12 so as to reduce costs. As discussed, the engagement and/or interconnection between adjacent assemblies 12 within the heat exchanger substantially improves stress distribution and resistance to distortion. Further, the supports 10 shown herein strengthened the heat exchanger without significant fin area loss. The supports 10 additionally eliminate, in many applications, the need for a central header. For example, in a typical vertical radiator application involving tube-and-fin assemblies 12 in excess of forty (40) inches, the flexibility of the assemblies 12 often mandates the use of a central header. This significantly increases the cost of the heat exchanger, complicates manufacture, and forfeits fin surface area. The supports 10 described herein are often an ample substitute for the central header, providing the advantages thereof without the disadvantages.

Maintaining assembly individuality is significant from a repair perspective. Should a single interior tube-and-fin assembly 12 require replacement, then only a minimum number of assemblies 12 need to be removed in order to obtain access to the damaged assembly 12. This individuality substantially reduces repair time and costs.

Finally, in severe applications, the strength of the heat exchanger can be further improved by use of longitudinal crossbars and by interlocking of supports 10 with the endwalls (not shown) of the heat exchanger. This provides a totally interlocked structure. For example and with particular attention to the preferred embodiment shown in FIGS. 5 and 6, a longitudinally extending crossbar may be utilized to support the columns of the heat exchanger. Such a crossbar would bolster the longitudinal interlocking provided by the supports 10.

Four preferred embodiments of the present invention have been described herein. It is to be understood, however, that various modifications and changes can be made without departing from the true scope and spirit of the present invention, which are defined by the following claims.

What is claimed is:

1. A support for application to a tube-and-fin assembly, a series of said tube-and-fin assemblies being individually removably incorporated into a heat exchanger, comprising:

a first support section defining a first lateral engagement surface; and a second support section defining a second lateral engagement surface;

said first and second support sections cooperatively defining a central channel adapted to receive said tube-and-fin assembly, a first longitudinal engagement surface, and a second longitudinal engagement surface, said first and second longitudinal engagement surfaces and said first and second lateral engagement surfaces engaging adjacent supports within said heat exchanger; and secure means for securing said second support section relative to said first support section to affix said support to said tube-and-assembly;

said first and second support sections cooperatively defining longitudinal and lateral interlock means for interlocking adjacent supports against substantially longitudinal and lateral forces;

said longitudinal interlock means including a longitudinal interlock projection and a longitudinal interlock groove, said longitudinal interlock projection and groove having a matched configuration and being substantially longitudinally aligned;

said lateral interlock means including a first lateral interlock projection and a pair of lateral interlock channels, one of said lateral interlock channels being displaced longitudinally with respect to said first lateral interlock projection, said lateral interlock projection and said lateral interlock channels having a matched configuration, said lateral interlock means being adapted to interlock adjacent supports within said heat exchangers irrespective of configuration;

said engagement and interlocking of adjacent supports structurally strengthening said heat exchanger and providing a force dissipation system within said heat exchanger, without substantially inhibiting individual removability of said tube-and-fin assemblies from said heat exchanger.

2. A support as claimed in claim 1 wherein said longitudinal interlock projection and groove have a mated configuration.

3. A support as claimed in claim 2 wherein said first lateral interlock projection and channels have a mated configuration.

4. A support as claimed in claim 1 or 3 wherein said first and second support sections are hingedly joined to form said support.

5. A support as claimed in claim 4 wherein said secure means includes a groove defined by said first support section and a lip defined by said second support section, said lip being adapted to interact with and engage said groove.

6. A support as claimed in claim 1 or 3 further comprising an air baffle substantially coplanar with and extending said first longitudinal engagement surface.

7. A support as claimed in claim 1 wherein the other of said lateral interlock channels is substantially longitudinally aligned with said lateral interlock projection.

8. A support as claimed in claim 1 wherein said lateral interlock means includes a second lateral interlock projection opposed to and substantially laterally aligned with said first lateral interlock projection, said lateral interlock channels being opposed and substantially laterally aligned.

* * * * *